US005143044A

United States Patent [19]

Bourquin

[11] Patent Number: 5,143,044

[45] Date of Patent: Sep. 1, 1992

[54] TRACKER ACTIVATOR FOR HUNTING BOW

[76] Inventor: Dana A. Bourquin, 3716 165th St., Blue Grass, Iowa 52726

[21] Appl. No.: 642,779

[22] Filed: Jan. 18, 1991

[51] Int. Cl.[5] ..... F41B 5/00

[52] U.S. Cl. ..... 124/88; 124/86

[58] Field of Search ..... 124/23.1, 24.1, 86, 124/88; 43/19

[56] References Cited

U.S. PATENT DOCUMENTS

| | | | |
|---|---|---|---|
| 3,949,730 | 4/1976 | Schoenberger | 43/19 X |
| 4,296,725 | 10/1981 | Broderick | 124/88 X |
| 4,378,781 | 4/1983 | Shiflett | 124/88 X |
| 4,383,516 | 5/1983 | La See | 124/88 |
| 4,726,348 | 2/1988 | Saunders | 124/88 X |
| 4,744,347 | 5/1988 | Dodge | 124/86 |
| 4,773,179 | 9/1988 | Corley | 124/86 X |

*Primary Examiner*—Randolph A. Reese
*Assistant Examiner*—Jeffrey L. Thompson

[57] ABSTRACT

The invention relates to an improvement in hunting bows, more especially in the area of the system for tracking the game by a container-stored string or cord that has its free end attached to the arrow so as to follow the flight of the arrow. The problem to be solved arises from the inadvertent failure of the hunter to "uncork" the container so as to free the string. The solution according to the present invention lies in an activator attachment for the bow and tracker string container via which the hunter, without losing sight of his quarry and without releasing his full grip on the bow, can uncork the container and thus free the string. The attachment includes a finger-actuated lever and slide mechanism whereby the cover or cork of the container, which normally engages the string, can be quickly and easily displaced.

11 Claims, 1 Drawing Sheet

TRACKER ACTIVATOR FOR HUNTING BOW

BACKGROUND OF THE INVENTION

It is known in the bow hunting art to equip the bow with a container for holding a supply of tracker string or cord. The container or can typically is closed by a removable cork or cover which, when in place, seizes the string and prevents its easy withdrawal from the container. In a not unusual situation, the hunter will manually uncork the container and withdraw a quantity of string sufficient to reach and be affixed to the front end of an arrow. Typically, the cork will be replaced so as to wedge the string in the container whereby the loop of string between the container and arrow cannot be pulled from the container as when snagged on a tree, bush, etc. Before releasing the arrow, the hunter must remember to uncork the container so as to enable free flow of string as the arrow departs from the bow. If the hunter forgets to uncork the container, the string, wedged by the cork, cannot perform its function.

According to the present invention, the problem is solved by the provision of activator means by which the hunter can uncork the container without releasing his grip on the bow and without losing sight of his target. The invention features activator or trip mechanism attachable to the container and having a lever disposed in proximity to the hunter's bow-gripping hand whereby the hunter, usually by use of his little finger, can actuate the mechanism to uncork the container while retaining his grip on the bow. Further features reside in the provision of an attachment that is simple to install, convenient to use and of a design that lends itself to economical manufacture and distribution.

DETAILED DESCRIPTION OF A PREFERRED EMBODIMENT OF THE INVENTION

Figure 1:
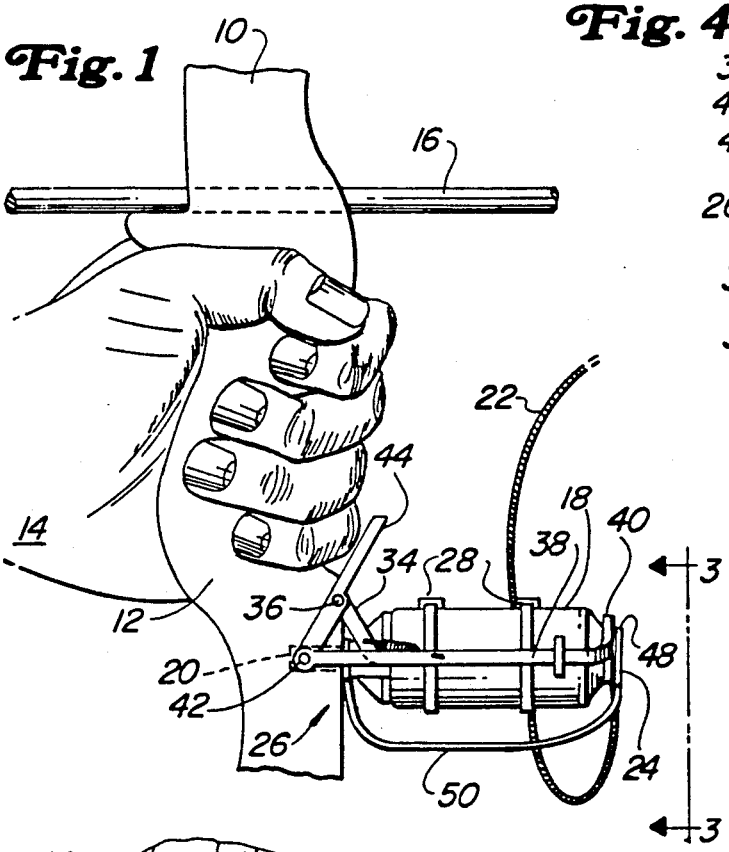
FIG. 1 is a fragmentary elevation showing a hunter's hand grasping the bow which is equipped with a typical tracker string container to which one form of the inventive activator is attached.
Figure 4:
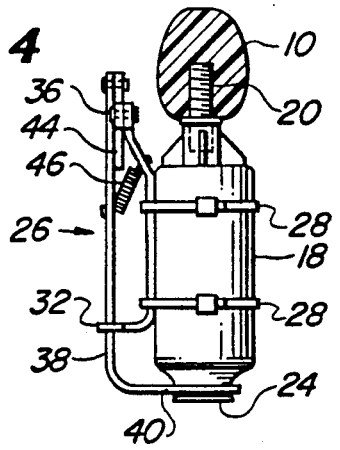
FIG. 4 is a plan, partly in section, as seen along the line 4—4 on FIG. 3.
Figure 3:
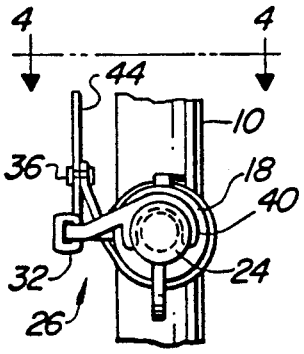
FIG. 3 is a front view as seen along the line 3—3 on FIG. 1.

Reference will be had first to FIG. 1 for a general overview of the basic structure, here including a typical hunting bow 10 having a conventional type grip 12. The hunter's hand is depicted at 14 as grasping the bow by the grip, and a portion of an arrow 16 is shown in place for sighting and ultimate release, all as is usual. Those versed in the art will recognize the disclosed bow, etc., as representative of hunters, bows in general and thus further details are deemed unnecessary.

Also known in the art is the provision of means for tracking the arrow of which the presently disclosed container or can 18 is representative. The bow is typically provided with a forwardly projecting threaded stud 20 by means of which the can is rigidly mounted to the bow just below and in front of the grip 12. As is known, this can may be of plastic or other suitable material, a detail that is not part of the invention. The can is of two-piece cylindrical construction separable to receive a spool (not shown) or like quantity of tracker string or cord, a portion of which is shown at 22 as extending from the can and towardly and forwardly for attachment to the front end of the arrow, a characteristic that is well known and requires no further illustration. After the spool is placed in the can, the can is reassembled and its smaller open front end (not shown) is closed by a cover or cork 24. When the cork is removed, a quantity of string may be withdrawn through this small front opening without danger of displacing the entire spool, after which the cork is replaced, serving not only to close the container but also to wedge the string between the cork and the opening. Since the string is thus wedged or held, it is prevented from inadvertent withdrawal from the can as by catching on a tree or other obstacles as the hunter stalks through the woods. It will be understood that the hunter will place his arrow in the usual guide (FIG. 1) after tying the string to the front end of the arrow and will carry the bow all ready for sighting and shooting should a target appear.

It is in this situation that the hunter, having taken aim, may recall that he hasn't uncorked the can 18, in which case, prior to the present invention, he would have to interrupt his shooting preparations and thus lose his quarry while he manually uncorks the can so as to free the string to track the arrow. According to the invention, this disadvantage disappears as will be clear from the following.

Figure 5:
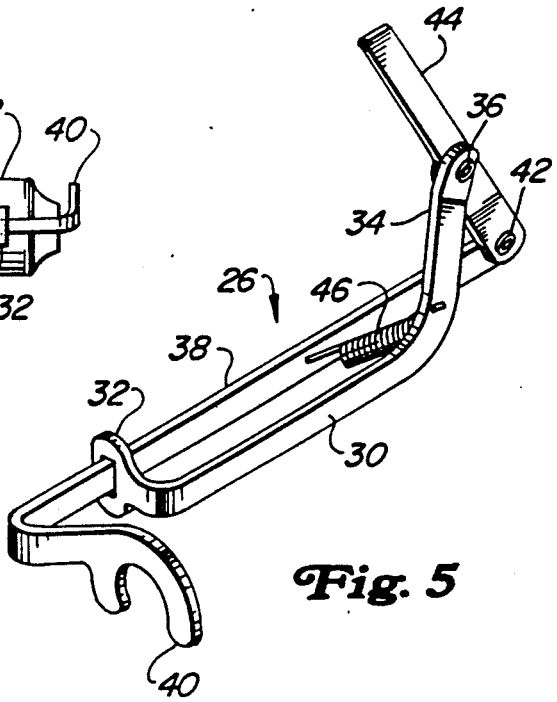
FIG. 5 is a perspective of the activator mechanism per se.

The activator attachment is designated in its entirety by the numeral 26, best seen by itself in FIG. 5. The activator includes means for the fixed attachment thereof to the bow, particularly via the can 18, as by a pair of bands 28 of any known type, such as used as flexible ties for many purposes. The activator has a fore-and-aft support or bar 30 about which the can and the ties 28 are wrapped and secured so that the bar is relatively rigidly mounted on the can and thus on the bow. The bar is formed integrally at its front end with a slide portion 32 and at its rear end with an integral upturned part 34 which affords a transverse pivot 36. Also included in the activator is actuation linkage comprising an ejector element in the form of a slider 38 carried by the slide 32 for fore-and-aft movement. The front end of the slider is formed such as to engage the cork 24, as by being configured as a fork or yoke 40, and the rear end of the slider is pivotally connected at 42 to the lower end of a lever 44 that is rockable on the pivot 36. A coiled spring 46 is connected between the bar 30 and the slider 38 and acts to bias the slider to the rear whereby the lever 44 is biased forwardly (FIGS. 1 and 5). The cork is flanged at 48 so that the fork on the slider 38 is received between the flange and the terminal front end of the can 18 in such manner that when the slider is moved forwardly, the cork is displaced forwardly off the front end of the can. As is conventional, the cork is tethered to the bow at 50, as by being attached to the stud 20 in known fashion, which of course prevents loss of the cork.

Figure 2:
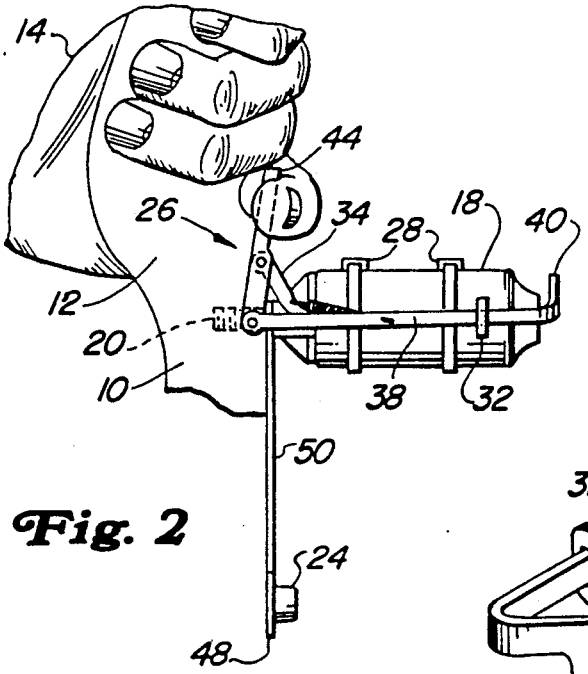
FIG. 2 is similar view, showing the tripped activator functioning to uncork the container.

In use and operation, the hunter already possessing a bow equipped with a can 18 or its equivalent, may purchase an activator as described and claimed herein and attach it to the can as by the ties 28, for example. He will complete the attachment by engaging the slider fork with the flanged cork after he replaces the cork following his withdrawal of enough tracker string to make the connection with the arrow, per usual practice. In this instance, however, following sighting and aiming, it is not necessary to forego the shot in the event he suddenly remembers that he has forgotten to uncork the can. Instead, he simply trips the lever with his finger as shown in FIG. 2 while regaining his condition or position prior to releasing the arrow. Tripping the lever of course moves the slider forwardly to unseat the cork, which drops clear of the can, being retained by the tether 50. Since the can is normally mounted in proximity to the grip 12, attachment of the mechanism to the can places the lever in convenient position for the hunter's little finger while he retains his grasp of the bow.

It will be seen that the attachment may be provided for affixation to a can already mounted on the bow as well as part of combination can and mechanism unit in the event that the purchaser's bow is without the can. Further, various other modifications may be made in the preferred embodiment disclosed, all without departure from the spirit and scope of the invention.

I claim:

1. For use with a hunter's bow having adjacent to its grip portion a container for holding a supply of arrow-tracking string normally retained in the container by a removable cover on the container: an activator mechanism comprising a support, means engageable between the support and the container for mounting the support on the container, ejector means movably carried by the support and including a portion engageable with the cover when the cover is on the container, said ejector means having an actuator portion manually operative by the hunter's hand grasping the grip portion of the bow for causing the ejector means to remove the cover from the container.

2. The activator mechanism according to claim 1, in which said portion of the ejector means includes an ejector element for engaging the cover when the cover is on the container, the actuator portion is a member separate from the ejector element and movably mounted on the support and articulately connected to the ejector element, and said actuator member projects in proximity to the grip portion of the bow for actuation by the hunter's bow-grasping hand.

3. The activator mechanism according to claim 2, in which the ejector element is slidable on the support, the actuator member is a lever pivoted to the support and rockable to move the ejector element for removing the cover.

4. The activator mechanism according to claim 2, in which the activator member is movable from an initial position for moving the ejector element and a biasing means is operative to bias the activator member to return to said initial position.

5. For use with a horizontally elongated arrow-tracking string container having front and rear ends and mountable at its rear end on a hunter's bow adjacent to the grip portion of the bow and having an open front and closed by a removable cover: activator mechanism comprising an elongated fore-and-aft support adapted for affixation to the container to lie horizontally lengthwise of the container, a fore-and-aft extending ejector element slidable fore-and-aft on the support between retracted and operative positions and having front and rear ends, said front end being configured to engage the closed cover, and a manually operative lever pivoted on the support and engaging the rear end of the ejector element for moving said element to its operative position for removing the cover.

6. The activator mechanism according to claim 5, including means biasing the lever to a position holding the ejector element in its retracted position.

7. The activator mechanism according to claim 5, in which the rear end of the support is elevated to a position above the top of the container, and the lever is pivoted to said elevated rear end.

8. The activator mechanism according to claim 5, in which the front end of the ejector element is a yoke engageable with the closed cover.

9. For use with a hunter's bow having adjacent to its grip portion a container for holding a supply of arrow-tracking string normally retained in the container by a removable cover on the container: activator mechanism, comprising a support mountable on the bow adjacent to the grip portion, ejector means movably carried by the support and including a portion engageable with the cover when the cover is on the container, said ejector means having an actuator portion manually operative by the hunter's hand grasping the grip portion of the bow for causing the ejector means to remove the cover from the container.

10. The activator mechanism according to claim 9, in which said portion of the ejector means includes an ejector element for engaging the cover when the cover is on the container, the actuator portion is a member separate from the ejector element and movably mounted on the support and articulately connected to the ejector element, and said actuator member projects in proximity to the grip portion of the bow for actuation by the hunter's bow-grasping hand.

11. The activator mechanism according to claim 10, in which the ejector element is slidable on the support, the actuator member is a lever pivoted to the support and rockable to move the ejector element for removing the cover.

* * * * *